US010125609B2

(12) United States Patent
Dubynskyi et al.

(10) Patent No.: US 10,125,609 B2
(45) Date of Patent: Nov. 13, 2018

(54) DEVICE FOR OBTAINING MECHANICAL WORK FROM A NON-THERMAL ENERGY SOURCE (VARIANTS)

(71) Applicants: Igor Mykolaiovych Dubynskyi, Kyiv (UA); Andrey Igorevich Dubinskiy, Moscow (RU)

(72) Inventors: Igor Mykolaiovych Dubynskyi, Kyiv (UA); Andrey Igorevich Dubinskiy, Moscow (RU)

( * ) Notice: Subject to any disclaimer, the term of this patent is extended or adjusted under 35 U.S.C. 154(b) by 0 days.

(21) Appl. No.: 15/571,126

(22) PCT Filed: Oct. 19, 2015

(86) PCT No.: PCT/UA2015/000097
§ 371 (c)(1),
(2) Date: Nov. 1, 2017

(87) PCT Pub. No.: WO2017/039560
PCT Pub. Date: Mar. 9, 2017

(65) Prior Publication Data

US 2018/0171801 A1 Jun. 21, 2018

(30) Foreign Application Priority Data

Aug. 28, 2015 (UA) ..... a 2015 08452

(51) Int. Cl.
*F01B 21/04* (2006.01)
*F01B 29/02* (2006.01)
(Continued)

(52) U.S. Cl.
CPC ..... *F01B 21/04* (2013.01); *F01B 29/02* (2013.01); *F01C 1/00* (2013.01); *F01C 1/356* (2013.01); *F02B 73/00* (2013.01)

(58) Field of Classification Search
CPC .. F01B 21/04; F01B 29/02; F01C 1/00; F01C 1/356; F02B 73/00
See application file for complete search history.

(56) References Cited

U.S. PATENT DOCUMENTS 398,988 A 3/1889 Tickle
2,200,198 A 5/1940 Beach
(Continued)

FOREIGN PATENT DOCUMENTS

DE 4131627 A1 3/1993
EP 013312 B1 4/2010
(Continued)

*Primary Examiner* — Jesse Bogue
(74) *Attorney, Agent, or Firm* — Nadya Reingand; Yan Hankin

(57) ABSTRACT

The invention relates to mechanical engineering. The present device for obtaining mechanical work from a non-thermal energy source comprises a cylindrical housing, a rotor, a vacuum chamber, movable elements, and systems for removal and supply of a working fluid. The rotor is provided with blades and is fastened to the power shaft, disposed inside the housing. The chamber is formed by the outside surface of the bladed rotor and the inside surface of the housing. The movable elements are mounted in diametric opposition inside the housing of the device and divide the chamber into equal parts. The shaft and blades of the rotor are hollow. The inlet ports and outlet ports are provided in surfaces of the rotor blades. Or outlet ports are provided in the housing. The technical result is an increase in the output, efficiency and environmental friendliness of the device, together with a simplified design.

11 Claims, 2 Drawing Sheets

(51) Int. Cl.

| | |
|---|---|
| ***F01C 1/356*** | (2006.01) |
| ***F01C 1/00*** | (2006.01) |
| *F02B 73/00* | (2006.01) |

(56) References Cited

U.S. PATENT DOCUMENTS

| | | | | | |
|---|---|---|---|---|---|
| 2,328,451 | A | | 8/1943 | Hedman | |
| 4,519,206 | A | * | 5/1985 | van Michaels | F02B 53/02 123/204 |
| 4,657,009 | A | * | 4/1987 | Zen | F01C 1/46 123/204 |
| 5,282,356 | A | * | 2/1994 | Abell | F02C 3/165 416/21 |
| 5,501,586 | A | | 3/1996 | Edwards | |
| 5,560,196 | A | * | 10/1996 | Schlote | F01D 1/32 60/39.35 |
| 6,468,061 | B2 | | 10/2002 | Dyktynski et al. | |
| 8,181,624 | B2 | * | 5/2012 | Van Blaricom | F01C 1/123 123/237 |
| 8,333,060 | B2 | * | 12/2012 | Witteveen | F02C 3/16 60/39.34 |
| 8,591,174 | B1 | * | 11/2013 | Gao | F03D 1/06 415/80 |
| 2004/0011320 | A1 | | 1/2004 | Wooldridge | |

FOREIGN PATENT DOCUMENTS

| | | | |
|---|---|---|---|
| RU | 2175100 | C2 | 5/2005 |
| RU | 2289701 | C1 | 12/2005 |
| RU | 2329383 | C2 | 7/2008 |

* cited by examiner

A – A

DEVICE FOR OBTAINING MECHANICAL WORK FROM A NON-THERMAL ENERGY SOURCE (VARIANTS)

CROSS-REFERENCE TO RELATED APPLICATIONS

This application is a National Phase Entry of International Patent Application No. PCT/UA2015/000097, filed on Oct. 19, 2015 and claims priority to Ukrainian Patent Application No. a 2015 08452, filed on Aug. 28, 2015, the entire specifications of both of which are expressly incorporated herein by reference.

FIELD OF THE INVENTION

The invention relates to the field of mechanical engineering, particularly to the mechanical work, and can be used in production of engines or combined autonomous electric generators and as a vacuum-and-atmospheric rotary power amplifier design of rotary engines where an external power supply is used for generation of (hereinafter referred to as VARPA) in power units of ships and locomotives.

BACKGROUND OF THE INVENTION

There are known atmospheric engines, which operation is based on the use of atmospheric pressure as an external source of non-thermal energy converted into mechanical work.

There is a known device, which uses atmospheric pressure as an external energy source to produce mechanical work (patent application DE 4131627 A1, F01B 29/02, 1993).

Such device consists of a fixed cylinder with a reciprocating moving piston connected to a crank by a crank rod. The atmosphere is pressurized or exhausted through channels in the closed end of the cylinder.

As demonstrated by bench tests of an analogous device carried out by the authors of the claimed technical solution, the disadvantage of such device is the following: when the frequency of reciprocating motion of the piston exceeds 3 Hz (180 rotations per second), the atmospheric pressure on the outside of the end surface of the piston in the open part of the cylinder, where the piston is in contact with air environment, starts to decrease resulting in a sharp reduction of the device efficiency. This is due to turbulent processes in air environment within the inner chamber of the cylinder.

There is a known device for vacuum-and-atmospheric cycle of supply of non-thermal external energy, which uses atmospheric pressure as an external energy source to produce mechanical work (in particular, to move loads relative to the supporting and underlying surfaces) (the patent UA No. 89112, B65G 7/00, 2009, and the patent EA No. 013312, 2010).

Such device consists of a support mounted on the underlying surface, a bearing platform with a bearing surface, load platform rigidly connected with relocated load, a working cavity with operating medium executed as a bellows with an elastic side surface which upper base is rigidly connected with the supporting surface and lower base is rigidly connected with the load platform. The working cavity is connected with the exhaust system through the exhaust valve and with the supply system through the pressurization valve. The device also provides a closed cycle of operating medium movement. The crank mechanism with the rotating shaft is rigidly connected to the lower base of the working cavity.

The asymmetric rotary engine with a continuously operating torque that relates to internal combustion engines (application WO/2004/007926) is a device, which is close to the claimed invention by its design.

This rotary internal combustion engine (ICE) comprises one or more movable concave profiles and a stationary convex elliptical surface. The movable profiles are constrained in moving around a stationary convex surface to form a working space between them. The rotary engine comprises a chamber limited by the outer wall of the chamber, the rear wall of the chamber, and the inner wall of the chamber, which surrounds an isolated section. The chamber has an inlet, an outlet, and the ignition opening. The concave profile can move within the chamber and interact, while sliding, with one or more of the outer and inner chamber walls. The crankpin is located on the concave profile. The crank disk can intake the crankpin and become driven by it. The crankshaft is located in such a way that it passes through the isolated section and is connected with a crank disk. The end plate, a concave profile, the rear wall of the chamber and the inner wall of the chamber form a cavity with an operating medium.

A method of creating continuously acting torque in the expansion stroke of the rotary engine includes forming an operating medium and moving concave profile around the stationary convex inner wall of the chamber by a smooth displacement of the profile along the outer wall of the chamber.

The disadvantages of the engine are a complex form of its basic mating sealing surfaces and as a result a decrease in sealing capacity and specific power because of the leakage of operating medium through gaps.

The main disadvantage of all the above devices is the need to convert the reciprocating motion into the rotary motion by a crank mechanism. This leads to a 50% power loss on the shaft of the device. Unlike internal-combustion engine where the pressure force of the operating medium decreases rapidly during the motion of the piston, the vacuum-and-atmospheric engine (VAE) provides the constant atmospheric pressure (which does not change in absolute value) on the end of the piston or bellows during the expansion stroke, thus preventing 50% power loss.

The closest device to the claimed invention by its design is a Panchenko modified rotary engine (patent RU 2289701, IPC 7 F02 B 53/00). This internal combustion engine is a four-stroke engine comprising two or more sections, each of which includes the following components: a cylindrical housing and a rotor (the rotors of all the sections are mounted on the same shaft and are displaced by a certain angle), the elements of supply and exhaust of operating medium, and a compression chamber. The engine also comprises two separating flaps, which contact with the rotor surface, separate the elements of supply of operating medium and exhaust of spent operating medium, and divide the rotor cavity into two chambers. The rotor is provided with two streamlined blades, which contact with end lugs of both flaps and divide the rotor cavity into four chambers; each rotor blade has a working cavity with the valve and a sliding window.

The disadvantage of this design is the arrangement of working cavities with valves and sliding windows that act as separating flaps between the compression and expansion sections, which are tightly in contact with the surface of moving rotor and stationary housing. Such arrangement greatly complicates the design of the engine and deteriorates manufacturability and service life of the device. In addition, any leakage of the fuel mixture into the compression section caused by jamming of a separating flap or any leakage in the fuel system may cause an explosion, obviously resulting in high explosion risk of the engine.

The remaining four variants of engine design offer various options of flap actuators and various types of operating mediums, that does not change the principle of operation of this device. Basically, this design can only operate in internal combustion engines, which makes it impossible to apply the vacuum-and-atmospheric cycle of non-thermal external energy supply.

SUMMARY

The aim of the invention is to remedy these disadvantages, significantly increase the capacity and performance coefficient of the device, as well as its efficiency and environmental safety, while simplifying its design.

For this purpose, two versions of the device with the vacuum-and-atmospheric cycle of non-thermal external energy supply for production of mechanical work are claimed.

The claimed device comprises a cylindrical housing with the power shaft; a rotor fixed to the shaft within the device housing and having at least two streamlined blades, which ends are in contact with the inner surface of the housing and can slide along the surface.

The device also comprises movable elements mounted diametrically opposite in the device housing, which divide the cavity formed by the outer surface of the rotor with blades and the inner surface of the housing into equal parts and which ends are in contact with the outer rotor surface and can slide along the surface.

The device also comprises systems of controllable supply and exhaust of operating medium with inlets and outlets, respectively.

The innovation of the device according to the first claimed variant is that the device comprises a vacuum cavity to allow the operation of the device from an external source of non-thermal energy; the hollow shaft rotor and blades contain the systems of controllable supply of operating medium. Inlets are located on the surfaces of rotor blades and ensure the supply of the operating medium into each of the halves of the device cavity formed by the movable elements.

Slit-shaped inlets and outlets are equipped with nozzles so that during the rotor spinning they are vacuum-tight closed by the ends of movable plates and rotor blades, respectively.

The power-generating end of the rotor shaft is power-driven by a drive motor, and the power take-off end of the rotor shaft is connected to a power generator or other power load object.

The innovation of the device according to the second claimed variant is that the device comprises a vacuum cavity to allow the operation of the device from an external source of non-thermal energy; the hollow shaft rotor and blades contain the systems of controllable supply and exhaust of operating medium.

Inlets and outlets are located on the surfaces of rotor blades and ensure the supply or exhaust of the operating medium into each of the halves of the device cavity formed by the movable elements. These inlets and outlets can be equipped with nozzles to accelerate the supply of operating medium into working cavities.

Slit-shaped inlets and outlets are vacuum-tight closed by the ends of movable plates during the rotor spinning.

The power take-off end of the rotor shaft is connected to a power generator or other power load object.

The device housing additionally comprises inlets and outlets of controlled bypass supply/exhaust of the operating medium into each of the halves of the device cavity formed by the movable elements designed to start the device.

For both claimed variants of the device design, the housing may comprise additional vacuum cavities located in series on the same rotor shaft and separated by a vacuum-tight stationary partitions to increase the power output and provide a more stable operation of the device.

Each cavity is divided into equal parts by additional blades and movable plates located along the axis of symmetry; the blades of each subsequent cavity are mounted on the rotor with axisymmetric radial displacement relative to the blades of the previous cavity.

Thus, the claimed device design provides the pressure difference between the surface of the blade from the side of the vacuum chamber where the vacuum is created and the opposing surface of the blade from the side of the vacuum chamber where the atmosphere or other gaseous operating medium under atmospheric or other pressure is supplied in order to obtain the pressure force from a non-thermal energy source to rotate the rotor.

The separating elements (for example, in the form of plates) can move allowing free sequential passage of the blades from one part of the vacuum chamber to another while the rotor is spinning.

In their turn, the blades moving between the movable separating plates divide each half of the vacuum chamber in which they are located into two vacuum chambers with variable volumes. For example, if the rotor is spinning clockwise, the volume of one part of the chamber between the left movable plate and the left surface of the blade moving away from it will increase, and the volume of another part between the right movable plate and the forthcoming blade will decrease.

While the rotor is spinning, the second blade, located diametrically opposite, will increase and decrease the variable volumes between the right and left plates respectively.

The atmosphere is supplied into expanding volumes and the operating medium is simultaneously exhausted from decreasing volumes to create a difference in pressure on opposite sides of the blades.

According to the first variant of the design of the claimed device, the atmosphere or other gas is supplied through the shaft cavity and the hollow blade, which surface from the side of the expanding volume contains the inlets through which the operating medium is supplied into the expanding volume. Such supply of the operating medium allows to completely eliminate pressurization valves and reduce to a minimum the parasitic volumes of supplying system, which significantly increases the power output and efficiency of the device. While the atmosphere is supplied, the operating medium is exhausted through controllable valves located on the device housing before the movable plate in a decreasing volume where the low pressure is constantly being produced by exhausting the operating medium by a vacuum pump.

According to the second variant of the design of the claimed device, the supply and exhaust/pumping of the operating medium is performed directly through the inlets and outlets located in the surfaces of hollow blades and hollow rotor shaft that allows not to use pressurization and exhaust valves at all, while ensuring the maximum possible efficiency of the device. Flows of supplied and exhausted operating medium can be controlled in any optimal location of this configuration of the device.

Thus, the claimed design ensures that the force of atmospheric pressure, which makes the rotor spin, is also constantly acting on both blades of the rotor from the side of expanding volumes.

Power and torque of the device depends on the following: the volume of the vacuum chamber; the speed of exhaust; the mean diameter of the vacuum chamber; the total surface area of the blades under the atmospheric pressure, located diametrically opposite on the shaft.

An important advantage of the proposed scheme and the principle of the device operation is that while the rotor is spinning, the blades are constantly under the atmospheric pressure that produces a constant torque to the power load object, unlike the prototype where the four-strike cycle is used and three-quarters of the cycle are idle.

Thus, the external potential energy of the atmosphere is used as the driving force in the claimed device; and this energy is converted into mechanical work and is a practically permanent source of clean energy accessible at any time and in any place. In this case, solar energy, which creates the Earth's atmosphere, and kinetic energy, which is widely used in the form of wind in wind energetics, are originally used as natural sources of energy. As in the case of wind turbines, the work of the claimed device is performed in an open energy system and does not contradict Conservation laws.

The driving force of the claimed device is an external non-thermal source of energy—the atmospheric pressure, that's why the process of the operating medium combustion is absent and, as a result, there is no any emission of harmful substances into the atmosphere. In its turn, this contributes to sustainability and ecological safety of the claimed device.

Thus, the listed features of the claimed device are required and sufficient grounds to achieve the object of the invention.

BRIEF DESCRIPTION OF THE DRAWINGS

FIG. 1 shows the design scheme of the first variant of the claimed device. Two vacuum chambers located in series on the same shaft are shown as an example. The right vacuum chamber is of cylindrical shape, and the housing of the left one is of spherical shape, as an option, which can be recommended to create sliding vacuum seals for big-volumed vacuum chambers.

FIG. 2 shows A-A section of FIG. 1.

FIG. 3 shows the design scheme of the second variant of the claimed device. Two vacuum chambers of different configurations located in series on the same shaft are also shown as an example.

FIG. 4 shows A-A section of FIG. 3.

DETAILED DESCRIPTION OF THE PREFERRED EMBODIMENT

The schemes of supply and exhaust flows of the operating medium within the device housing are marked with arrows on all the drawings.

The claimed device comprises the housing 1, the hollow power shaft 2 located in the housing, the rotor with blades 3 mounted on the shaft, the blades are in contact with the polished inner surface of the housing 1 and can slide along this surface.

Figure 2:
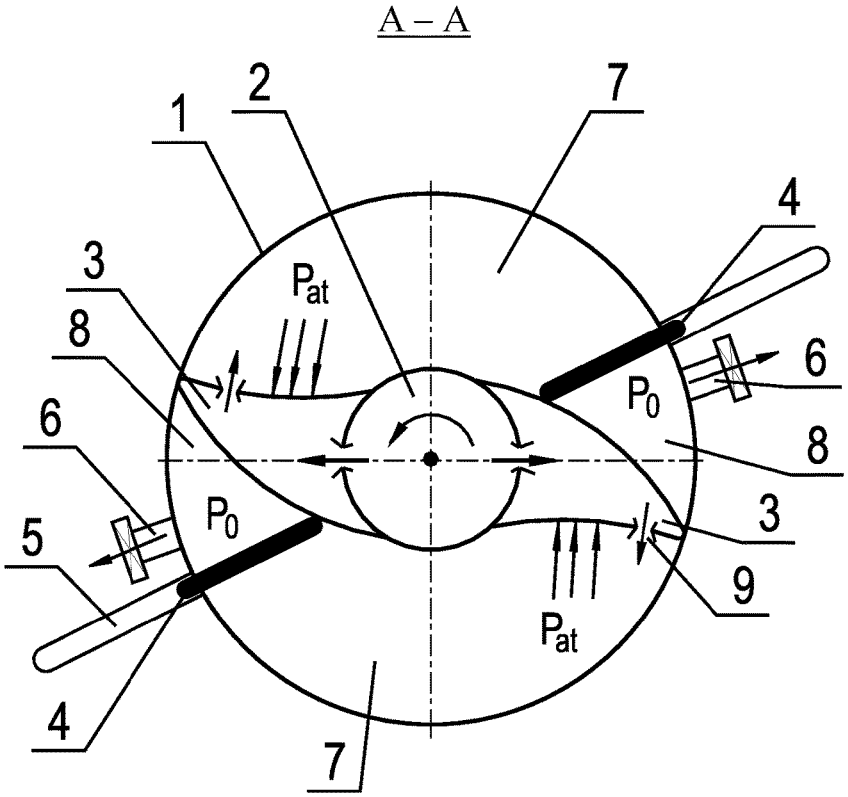
Figure 4:
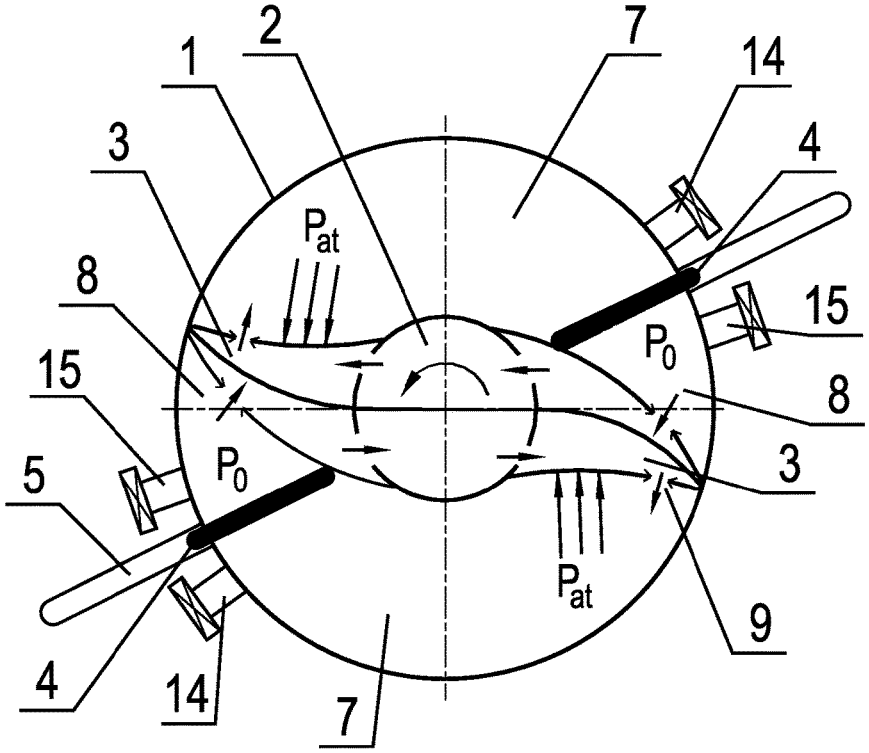

Movable elements 4 (FIGS. 2 and 4) mounted diametrically opposite in the device housing 1, which divide housing cavity into equal parts and which ends are in contact with the outer surface of rotor blades 3 and can simultaneously slide along this surface. Movable elements 4 are located in the housing 1 and can move longwise inside the projections 5 of the housing.

Outlets 6 (FIGS. 1 and 2) for operating medium exhaust are in the housing 1 of the device.

Rotor blades 3 divide each half of the cavity of the housing 1 into two working chambers 7 and 8 (FIGS. 2 and 4) with volumes which vary cyclically in the process of rotation of the rotor. Outlets 9 are in the surfaces of the blades 3, which are opposite relative to the shaft 2.

Any power load object (a generator or a screw-propeller, depending on the task) can be connected to the power take-off end of the rotor shaft 10.

Figure 1:
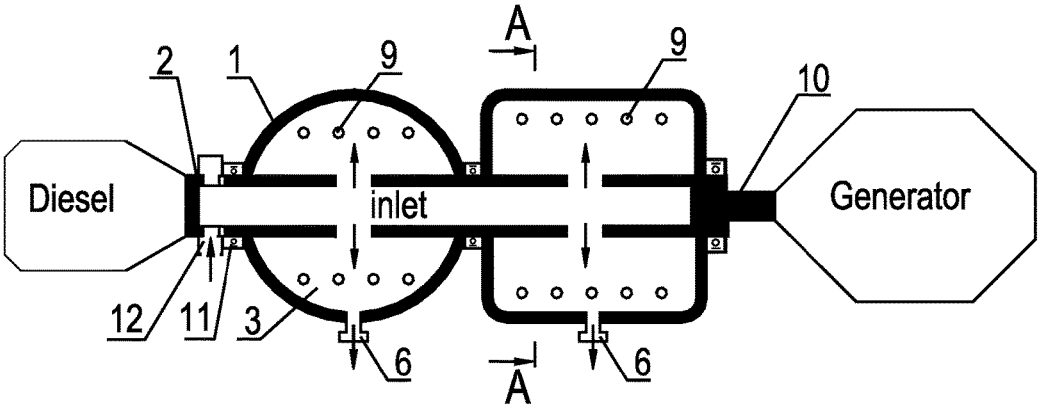
FIG. 1-4 show the schemes of design variants of the claimed device.
Figure 3:
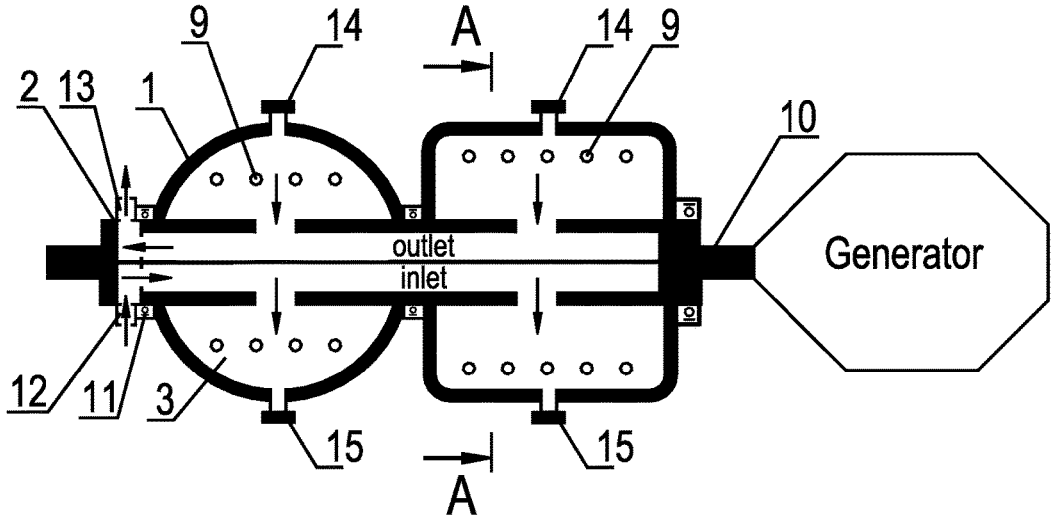

The power shaft 2 is mounted in the housing 1 of the device on vacuum-tight bearings 11 (FIGS. 1 and 3).

The System of Operating Medium Supply Includes (FIGS. 1 and 3):

- inlet 12 for the supply of operating medium into the cavity of the shaft 2;
- supply channel located in the internal cavity of the rotor shaft 2 and connected to the internal cavities of the blades 3;
- inlets [9] for the supply of operating medium into each half of the device cavity formed by movable elements 4.

The System of Operating Medium Exhaust Includes:

- for the first variant of the claimed device design (FIGS. 1 and 2): outlets [6] for the exhaust of the operating medium located in the device housing 1 in each half of its cavity formed by movable elements 4; valves connected to these outlets and outflow tubes to a vacuum pump located on the outside of the device housing (not shown in the schemes);
- for the second variant of the claimed device design (FIGS. 3 and 4): outlets 9 for the exhaust of the operating medium; channels for outlet (exhaust) and inlet (supply) of the operating medium located in the inner cavities of the shaft 2 of the rotor and the blades 3 and connected to external devices through the inlets 12 (FIGS. 1 and 3) and outlets 13 (FIG. 3).

According to the second variant of the claimed device (FIGS. 3 and 4), the device housing additionally comprises inlets 14 and outlets 15 of controlled bypass supply/exhaust of the operating medium into each of the halves of the device cavity formed by the movable elements. These inlets 14 and outlets 15 are connected by bypass tubes with the receiver and the exhaust system to start the device (not shown in the schemes). These are auxiliary structural elements to facilitate the start of the device and its put on stream.

As mentioned above, the housing 1 of the device is provided with a vacuum chamber to ensure the operation of the device from an external source of non-thermal energy; the chamber is divided into two equal halves formed by movable elements 4 in the form of plates, for example, which can move up and down in the projecting slots 5 in the housing.

The blades 3 are moved to the other half of the vacuum chamber by a vacuum-tight lift of separating plates 4 performed due to the inclined surface of the blades or due to the projecting slots 5 along which carrier bearings of the separating plates move synchronously with the blades (not shown in the schemes).

The separating plates are under a sufficiently strong force directed perpendicular to the movement of the plates, so it is important to use the projecting slots of required profile to lift the plates using bearings that greatly reduce the friction between blades and plates.

The separating plates from the side of the housing may be spring-assisted to provide a vacuum-tight sliding of their ends along the surface of the blades.

While the rotor is spinning, the separating plates slide along the curved surfaces of the blades and come into projecting slots in the housing, letting the blades pass into the next part of the vacuum chamber.

At the same time the separating plates constantly maintain the two parts of the vacuum chamber vacuum-tightly separated during the passage of the blades, which can be ensured by any conventional ways of vacuum-tight sliding motion of the surfaces. The blades, which have passed to the next half of the vacuum chamber, divide it vacuum-tightly into two working chambers 7 and 8 with cyclically varying volumes.

For the first variant of the device design (FIGS. 1 and 2), the atmosphere or other operating gas is pressurized through inlets 9 under at least atmospheric pressure into the expanding volume of chamber 7 between the blade surface and the separating plate from which the blade is moving away. The inlets 9 can be equipped with nozzles directed toward the expanding volume. The atmospheric pressure force is constantly acting on the blade surface until its transition to the next half of the vacuum chamber 8. The movement of pressurization of operating medium into the cavities of blade and power shaft 2 is marked with arrows.

The inlets 9 can be slit-shaped and they are sequentially closed when the blades are passing into the other part of the vacuum chamber.

While pressurizing, the vacuum pump exhausts the gas/atmosphere from the chamber with decreasing volume through the outlet 6 located in the housing.

The process of pressurization is repeated in the next half of the vacuum chamber, but the gas is exhausted through the corresponding outlet 6 of this half.

The force of atmospheric pressure, which makes the rotor spin, is also constantly acting on both blades of the rotor from the side of expanding volumes.

Thus, the claimed design provides a permanent working cycle of the device with doubled torque on its power shaft. The action of the driving force is stopped only when the blade passes the separating plate, that is not more than 5-10 degrees of full revolution of the rotor. At least one more vacuum chamber is located on the same shaft to eliminate this gap in the driving force action; the rotor blades in the second chamber are located at 90° relatives to the blades of the first chamber providing constant and continuous torque of the shaft and increasing the power output.

The first variant of the claimed device design can be optimally applied as a vacuum-and-atmospheric rotor power amplifier (VARPA) of the drive motor (FIG. 1) described below For the second variant of the device design (FIGS. 3 and 4), the atmosphere or other operating gas is pressurized through inlets 9 under at least atmospheric pressure into the expanding volume of chamber 7 between the blade surface and the separating plate from which the blade is moving away. The inlets 9 are equipped with nozzles directed toward the expanding volume and accelerating the supply/exhaust of the operating medium (not shown in the drawing). The operating medium is exhausted from a decreasing volume through the outlets 9, located on the blade surface from the side of decreasing volume; the outlets can be equipped with nozzles directed toward the exhaust channel located in the cavities of the blade and the power shaft.

The device constructed in accordance with the second claimed variant can be successfully used as an autonomous power supply source (an electric generator).

According to this variant, the device additionally uses inlets 14 and outlets 15 of controllable bypass supply/exhaust of the operating medium, which are connected by bypass tubes with the initial receiver and the exhaust system to start the device (not shown in the schemes). Bypass inlets 14 and outlets 15 serve for the parallel supply and exhaust of the operating medium through the bypass tubes from the initial receiver (additional one, under the pressure).

For both variants of the claimed device design, the maximum force of atmospheric pressure on the blades can be achieved by maintaining the pressure at the level of 1000-10000 Pa in decreasing and exhausted volumes, which is ensured by the exhaust of the gas from decreasing volumes by vacuum pumps. In this case, the atmospheric pressure force $F_{at}$ from the side of expanding volumes is proportional to the total area S of the two surfaces of the blades:

$$F_{at}=P_{at}S=2P_{at}h(D_1-D_2)\ [\mathrm{N}] \tag{1}$$

with: $S=2(D_1-D_2)h\ [\mathrm{m}^2]$, where:

$P_a$ is the atmospheric pressure, Pa;

$D_1$ is the diameter of the inner surface of the housing, m;

$D_2$ is the diameter of the external surface of the rotor, m;

his the length of the blade along the axis of symmetry of the rotor, m.

Work $A_{rot}$ produced by the rotor is determined by the length of the path of blades between the separating plates:

$$A_{rot}=\varphi/8P_{at}h(D_2-D_1)^2\ [\mathrm{J}] \tag{2}$$

where φ is the angular displacement (in radians).

The power that can be obtained on the rotor power shaft, ignoring friction losses and at normal atmospheric pressure, is determined by rotation per minute (RPM) n and equals to:

$$N=\pi/4P_{at}h(D_2-D_1)^2n,\ [\mathrm{W}] \tag{3}$$

The exhaust is performed constantly by a vacuum pump.

High-power devices can use rotors with four, six or more blades located on the same shaft 2, which can be displaced relative to each other by a radial angle and separated by vacuum-tight separators to create, together with additional movable plates, additional vacuum chambers along the axis of symmetry of the rotor (FIGS. 1 and 3).

In this case, the number of separating plates and systems of supply/exhaust to/from separated sections of the vacuum chamber is increased according to additional working chambers with variable volume and the vacuum chambers.

Each additional chamber can have its own exhaust system and a vacuum pump providing the necessary speed of exhaust of working gas/atmosphere from the separated section of the vacuum chamber, thus allowing to increase the rotor speed. In this case, one supply system (through the power shaft cavity) can be used.

There can be more blades located radially on the rotor, which is determined by the design features to obtain the required parameters of the device.

This increases the power output of the device without increasing the diameter of the housing, at the same time the length of the rotor is increased, however, the uniformity of rotation is improved and a uniform flow of the operating medium exhausted by vacuum pumps is ensured. The number of control valves is not increased because the supply/exhaust is performed through the power shaft cavity, which greatly simplifies the design of the device.

The Example of Calculating the Power Output of the Device with the Following Parameters:

rotor diameter $D_1$=0.3 m;

inner diameter of the housing $D_2$=1.3 m;

length of the blade along the axis of symmetry of the rotor h=1 m.

In this case, the total area of surfaces of two rotor blades is S=1 $m^2$. Substituting these parameters in the formula (3), we'll get the device power output at 60 rpm:

$$N=\pi/2P_{ar}Sn=3.14/4*101300*1*1=159\text{ kW} \quad (4)$$

The exhaust from the vacuum chamber and the stable pressure within the exhausted sections of the vacuum chamber at the level of about 100-10,000 Pa should be ensured to obtain the required difference in pressure. The total volume of the vacuum chamber with the design parameters and taking into account the volume of the blades cavities is 0.4 $m^3$. The vacuum pump with exhaust speed of at least 400 l/s (1500 $m^3$/h) is required to ensure such pressure in the vacuum chamber, and the energy volume consumed by the pump will depend on the pump type. The balance between the energy generated by the rotor and the energy consumed to exhaust from the vacuum chamber will constitute the efficiency of the device.

The claimed device can be optimally applied as a vacuum-and-atmospheric rotor power amplifier (VARPA) in the main-line locomotives and power units of ships. For example, if the number of revolutions of the rotor is increased up to 120 rpm in the case under consideration, the power output on the screw of the power shaft will be of about N=318 kW, taking into account the losses. The torque will equal to:

$$M=2Fr=2F((D_2+D_1)*½)=101,300*2*0.8=162,080\text{ Hm} \quad (5)$$

Due to the fact that the torque does not depend on the rotor speed and thermal and mechanical losses are almost absent, the claimed power unit with these parameters can provide the required speed of the ship with quite a big displacement.

Estimated parameters of the device and its dimensions are determined by formulas (3) and (5).

The speed of exhaust from the vacuum chamber should be increased up to 1000 l/s or 3600 $m^3$/h to ensure these design parameters. Industrial vacuum pumps of Roots type provide the required exhaust speed at the motor shaft rotation speed of 1500-3000 rpm, while consuming 15-25 kW.

The vacuum pump motor is replaced by an auxiliary diesel engine of 25-40 kW, which rotates the shafts of the vacuum pump at 600-3500 rpm, to ensure the autonomy of operation of the power unit of the ship together with VARPA. In this case, the average power output of about 250-400 kW with torque of 160,000 Nm can be obtained on the power shaft of the screw-propeller of VARPA. Thus, the tenfold power gain will be obtained.

In this case, the rotor rotates at an average speed of 120 rpm, so the power shaft of the screw-propeller can be connected directly to the rotor without loss of power on the transmission. The speed of rotation and the stop of the rotor are regulated by valves and by the speed of rotation of the drive diesel engine shaft due to varying the supply and exhaust of the atmosphere to/from the vacuum chamber with variable volumes.

It is obvious that the use of VARPA in the ship's power unit can provide, ceteris paribus, fuel economy by approximately 10 times, which is a quite significant indicator for a long-term self-contained navigation. At the same time, VARPA will ensure the minimum vibration and noise of the power unit.

Fuel economy can be increased while maintaining the preset power on the power shaft, using a cascade variant of the design of the power unit with VARPA described below. A diesel generator is used in the first cascade, and booster VARPA is integrated between the diesel engine and the generator.

For example, the 10-15 kW diesel engine produces 50-100 kW at the output of the first cascade via the VARPA generator of the first cascade; the generated power is used by the VARPA motor of the second cascade, which power shaft can produce 500-1000 kW power output for its further transmission to the ship propeller.

The claimed device compares favorably with existing energy sources with the external power supply by the following characteristics:

- environmentally friendly VARPA powered by a permanent external source of non-thermal energy does not require the combustion of fossils or other fuels for its operation and does not produce any harmful emissions into the atmosphere;
- practically non-intermittent silent operation, without vibrations;
- having almost the same weight and dimensional characteristics with ICE, VARPA produces a significantly higher torque and its quite free variation at a design power, depending on the purpose of the device;
- stable and permanent operation at any time and under any weather conditions;
- 5-10 times less fuel consumption by autonomous power units of ships or power units of other purposes.

Vacuum equipment, which meets the requirements of creating VARPA to be used in autonomous power units of low and medium power output, exists and does not require any special development.

What we claim is:

1. A device for producing mechanical work from a non-thermal energy source, comprising the following components:

a cylindrical housing with a power shaft; a rotor fixed to the shaft within the device housing and having at least two streamlined blades, ends of the blades are in contact with an inner surface of the housing and can slide along the inner surface; a cavity formed by an outer surface of the rotor with the blades and the inner surface of the housing; movable elements mounted in the housing diametrically opposite, which divide the device cavity into equal parts; and ends the elements are in contact with the outer rotor surface and can slide along the outer surface; a system of controllable exhaust of an operating medium comprising exhaust valves in the device housing in each half of its cavity formed by movable elements; a system of controllable supply of the operating medium with pressurization valves; the device is characterized by a vacuum cavity and a hollow shaft rotor and hollow blades, cavities inside the shaft and the blades contain systems of controllable supply of the operating medium; pressurization valves are located in the cavities of the rotor blades and ensure the supply of the operating medium into each of the halves of the device cavity formed by the movable elements; at the same time, a power-generating end of the rotor shaft is power-driven by a drive motor, and the power take-off end of the rotor shaft is connected to a power generator or other power load object.

2. The device of claim 1, wherein slit-shaped pressurization and exhaust valves are equipped with nozzles so that during rotor spinning they are vacuum-tight closed by the ends of movable elements and rotor blades, respectively.

3. The device for producing mechanical work from a non-thermal energy source, comprising the following components:

a cylindrical housing with a power shaft; a rotor fixed to the shaft within the device housing and having at least two streamlined blades, ends of the blades are in contact with an inner surface of the housing and can slide along the inner surface; a cavity is formed by an outer surface of the rotor with the blades and the inner surface of the housing; movable elements mounted in the housing diametrically opposite, which divide the device cavity into equal parts; and ends of the movable elements are in contact with the outer rotor surface and can slide along the surface; a system of controllable exhaust and pressurization of an operating medium comprising exhaust and pressurization valves; the device is characterized by a vacuum cavity and a hollow shaft rotor and hollow blades, cavities inside the shaft and the blades contain systems of controllable supply of the operating medium; exhaust and pressurization valves are located in the cavities of the rotor blades and ensure an exhaust/supply of the operating medium into each of the halves of the device cavity formed by the movable elements; at the same time, a power take-off end of the rotor shaft is connected to a power generator or other power load object.

4. The device of claim 3, wherein slit-shaped pressurization and exhaust valves are equipped with nozzles so that during a rotor spinning they are vacuum-tight closed by the ends of movable elements.

5. The device of claim 3, wherein the device housing additionally comprises exhaust and pressurization valves for controlled bypass supply/exhaust of the operating medium into each of the halves of the device cavity formed by the movable elements.

6. The device of claim 1, wherein the housing additionally comprises vacuum cavities located in series on the rotor shaft and separated by a vacuum-tight stationary partitions; each cavity is divided into equal parts by additional blades and movable elements located along an axis of symmetry; the blades of each subsequent cavity are mounted on the rotor with axisymmetric radial displacement relative to the blades of the previous cavity.

7. The device of claim 4, wherein the device housing additionally comprises exhaust and pressurization valves for controlled bypass supply/exhaust of the operating medium into each of the halves of the device cavity formed by the movable elements.

8. The device of claim 2, wherein the housing additionally comprises vacuum cavities located in series on the rotor shaft and separated by a vacuum-tight stationary partitions; each cavity is divided into equal parts by additional blades and movable elements located along an axis of symmetry; the blades of each subsequent cavity are mounted on the rotor with axisymmetric radial displacement relative to the blades of the previous cavity.

9. The device of claim 3, wherein the housing additionally comprises vacuum cavities located in series on the rotor shaft and separated by a vacuum-tight stationary partitions; each cavity is divided into equal parts by additional blades and movable elements located along an axis of symmetry; the blades of each subsequent cavity are mounted on the rotor with axisymmetric radial displacement relative to the blades of the previous cavity.

10. The device of claim 4, wherein the housing additionally comprises vacuum cavities located in series on the rotor shaft and separated by a vacuum-tight stationary partitions; each cavity is divided into equal parts by additional blades and movable elements located along an axis of symmetry; the blades of each subsequent cavity are mounted on the rotor with axisymmetric radial displacement relative to the blades of the previous cavity.

11. The device of claim 5, wherein the housing additionally comprises vacuum cavities located in series on the rotor shaft and separated by a vacuum-tight stationary partitions; each cavity is divided into equal parts by additional blades and movable elements located along an axis of symmetry; the blades of each subsequent cavity are mounted on the rotor with axisymmetric radial displacement relative to the blades of the previous cavity.

* * * * *